US006216653B1

(12) United States Patent
Hara et al.

(10) Patent No.: US 6,216,653 B1
(45) Date of Patent: Apr. 17, 2001

(54) ELECTROMAGNETIC VALVE ACTUATOR FOR A VALVE OF AN ENGINE

(75) Inventors: Seinosuke Hara, Kanagawa; Yohji Okada, Ibaraki, both of (JP)

(73) Assignee: Unisia Jecs Corporation, Kanagawa (JP)

( * ) Notice: Subject to any disclaimer, the term of this patent is extended or adjusted under 35 U.S.C. 154(b) by 0 days.

(21) Appl. No.: 09/538,961

(22) Filed: Mar. 31, 2000

(30) Foreign Application Priority Data

Mar. 31, 1999 (JP) ..... 11-090674

(51) Int. Cl.[7] ..... F01L 9/04

(52) U.S. Cl. ..... 123/90.11; 251/129.01; 251/129.1; 251/129.16

(58) Field of Search ..... 123/90.11; 251/129.01, 251/129.02, 129.05, 129.1, 129.15, 129.16

(56) References Cited

U.S. PATENT DOCUMENTS 4,779,582 10/1988 Lequesne ..... 123/90.11
4,829,947 * 5/1989 Lequesne ..... 123/90.11
4,984,541 * 1/1991 Kawamura ..... 123/90.11
5,119,772 * 6/1992 Kawamura ..... 123/90.11
5,799,630 9/1998 Moriya et al. ..... 123/90.11
6,047,672 * 4/2000 Hanai et al. ..... 123/90.11

* cited by examiner

*Primary Examiner*—Wellun Lo
(74) *Attorney, Agent, or Firm*—Sughrue, Mion, Zinn, Macpeak & Seas, PLLC

(57) ABSTRACT

An electromagnetic valve actuator for a cylinder valve, including a pair of electromagnets including magnetic cores and coils serially connected and wound around the magnetic cores in the same direction. An armature is moveable against biasing forces of springs in one direction to open the cylinder valve and in the opposite direction to close the cylinder valve. A permanent magnet is prevented from being undesirably influenced by an opposing magnetic field relative to the permanent magnet.

8 Claims, 5 Drawing Sheets

ELECTROMAGNETIC VALVE ACTUATOR FOR A VALVE OF AN ENGINE

BACKGROUND OF THE INVENTION

The present invention relates to electromagnetic valve actuators which may be used for actuating a cylinder valve, for example, of an internal combustion engine of vehicles, by mainly using an electromagnetic force.

Such electromagnetic valve actuators have been disclosed in U.S. Pat. Nos. 5,799,630 and 4,779,582. The former of the conventional techniques includes a disk-like armature fixed to an intake valve of an engine, and valve-closing and valve-opening electromagnets that attract the armature for moving the intake valve to the closed and full open positions. There are provided a valve-closing spring for biasing the armature in such a direction as to move the intake valve toward the closed position and a valve-opening spring for biasing the armature in such a direction as to move the intake valve toward the full open position. Each electromagnet is connected to an electronic control unit that controls an energizing current for the electromagnet depending on operating conditions of the engine. The intake valve is operated to move to the closed and full open positions and held therein by association of the spring forces of the springs and the attractive forces of the electromagnets alternately energized. The latter of the conventional techniques includes a housing made of a magnetic material, an armature connected with an intake valve of an engine and moveably disposed within the housing, and a pair of compressed springs biasing the armature for retaining the valve in a neutral position between closed and full open positions of the valve. The armature has an H-shape and includes a sleeve portion extending along the center axis of the armature. A pair of electromagnets are disposed in such a manner that the armature is interposed therebetween. An annular permanent magnet is provided for holding the armature in the respective closed and full open position. The electromagnets include upper and lower cores having lower and upper faces opposed to the sleeve portion of the armature. The electromagnets include upper and lower coils that are wound around the cores and disposed on upper and lower faces of the permanent magnet, respectively. When the valve is placed in the respective closed and full open position, each coil is activated with a current therethrough to cancel the magnetic field of the permanent magnetic pole and allow the spring to move the valve member toward the other position. Thus, the motion of the valve is shifted by alternate energization of the coils.

However, in the actuator described in the former, upon the valve being moved between the closed and full open positions, the electromagnets are alternately activated with a current to attract the armature against the spring force of the springs. The valve is held in the closed or full open position by continuous energization of the electromagnet. This causes an increased consumption of electrical energy, resulting in undesirable increase in engine load and fuel consumption. In the actuator of the latter, the coils of the electromagnets are not connected in series and independently cooperate with the corresponding core to generate an opposing magnetic field relative to the magnetic field of the permanent magnet upon being energized for the cancellation of the magnetic field of the permanent magnet. The magnetic circuit is formed in which the magnetic flux passes through the core, the housing, the north pole of the permanent magnet and the south pole thereof, and the armature and returns to the core. The magnetic flux of the electromagnet thus passes through the permanent magnet in the direction reverse to the magnetic flux of the permanent magnet. Therefore, the permanent magnet is influenced by the opposing magnetic field relative to the permanent magnet and thus tends to be demagnetized. This will lead to considerable reduction of the durability of the permanent magnet. Further, since resistance in the magnetic circuit will be increased due to the passage of the magnetic flux through the permanent magnet in the reverse direction, the electric energy consumption required for the cancellation of the magnetic field of the permanent magnet will become greater.

SUMMARY OF THE INVENTION

The present invention contemplates solving the above-mentioned problems of the conventional actuator.

It is an object of the present invention to provide an electromagnetic valve actuator capable of reducing electric energy consumption of the electromagnets and preventing a permanent magnet from being demagnetized due to the influence of the opposing magnetic field, serving for increasing the durability of the permanent magnet.

According to one aspect of the present invention, there is provided an apparatus for actuating a cylinder valve of an engine, the cylinder valve having a closed position, a full open position and a neutral position between the closed and full open positions, the apparatus comprising:

an armature moveable in a direction of an axis, said armature including a sleeve portion extending in the axial direction and a disk portion connected with an inner periphery of the sleeve portion and adapted to be fixed to the cylinder valve;

a pair of springs biasing the armature toward a valve-neutral position corresponding to the neutral position of the cylinder valve;

a pair of electromagnets attracting the armature for moving the cylinder valve to the closed and full open positions, said electromagnets being disposed in an axially opposed relation to the armature, said electromagnets including a pair of axially spaced magnetic cores; and a permanent magnet retaining the armature for holding the cylinder valve in the closed and full open positions;

wherein the sleeve portion of the armature cooperates with the permanent magnet to define a first air gap radially extending therebetween and cooperates with each of the magnetic cores to define a second air gap radially extending therebetween, and the disk portion of the armature cooperates with each of the magnetic cores to define a third air gap axially extending therebetween and variable with the axial motion of the armature.

DESCRIPTION OF THE PREFERRED EMBODIMENT

Figure 1:
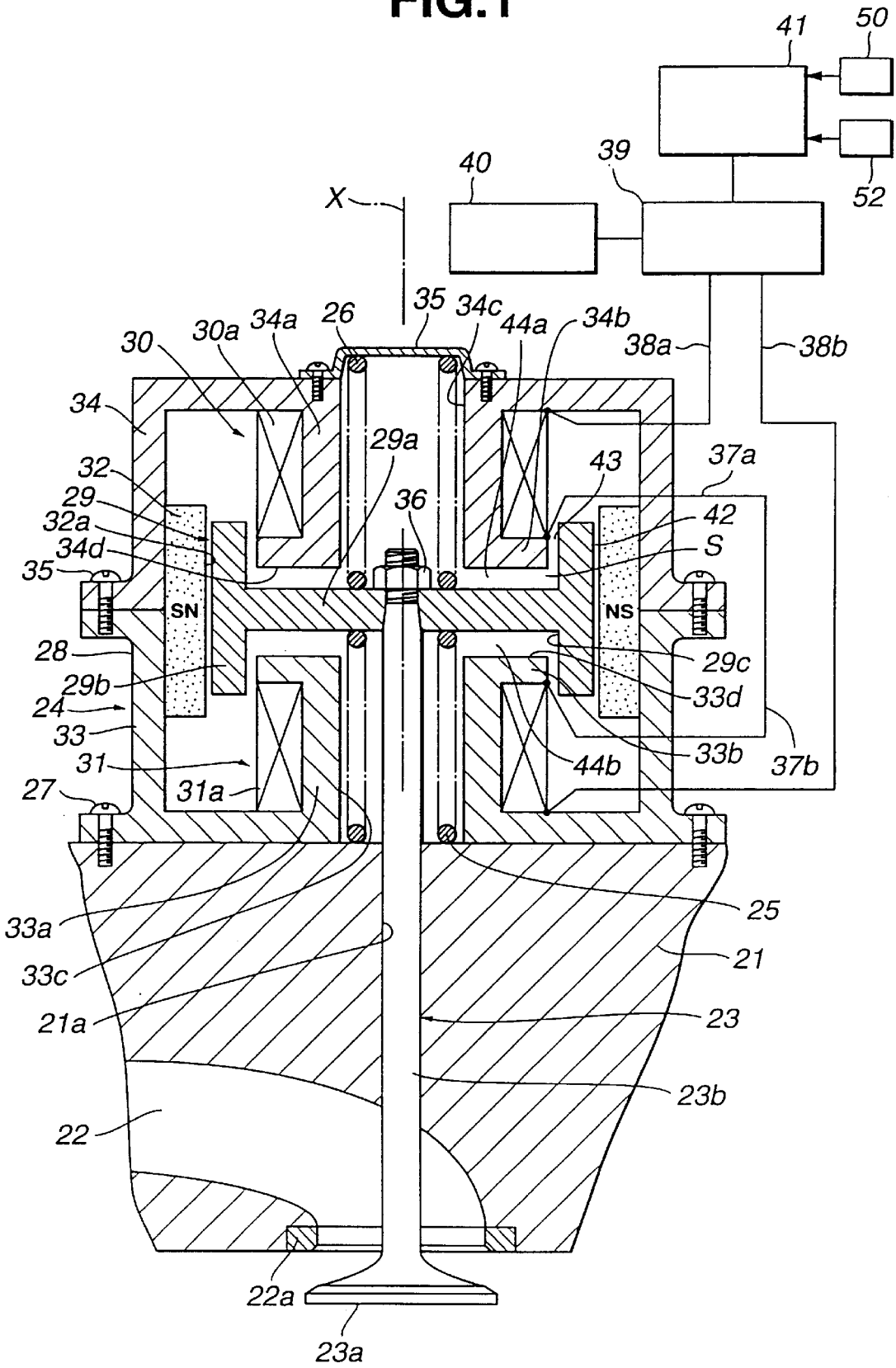
FIG. 1 is a vertical section of a preferred embodiment of an electromagnetic valve actuator according to the present invention.
Figure 2A:
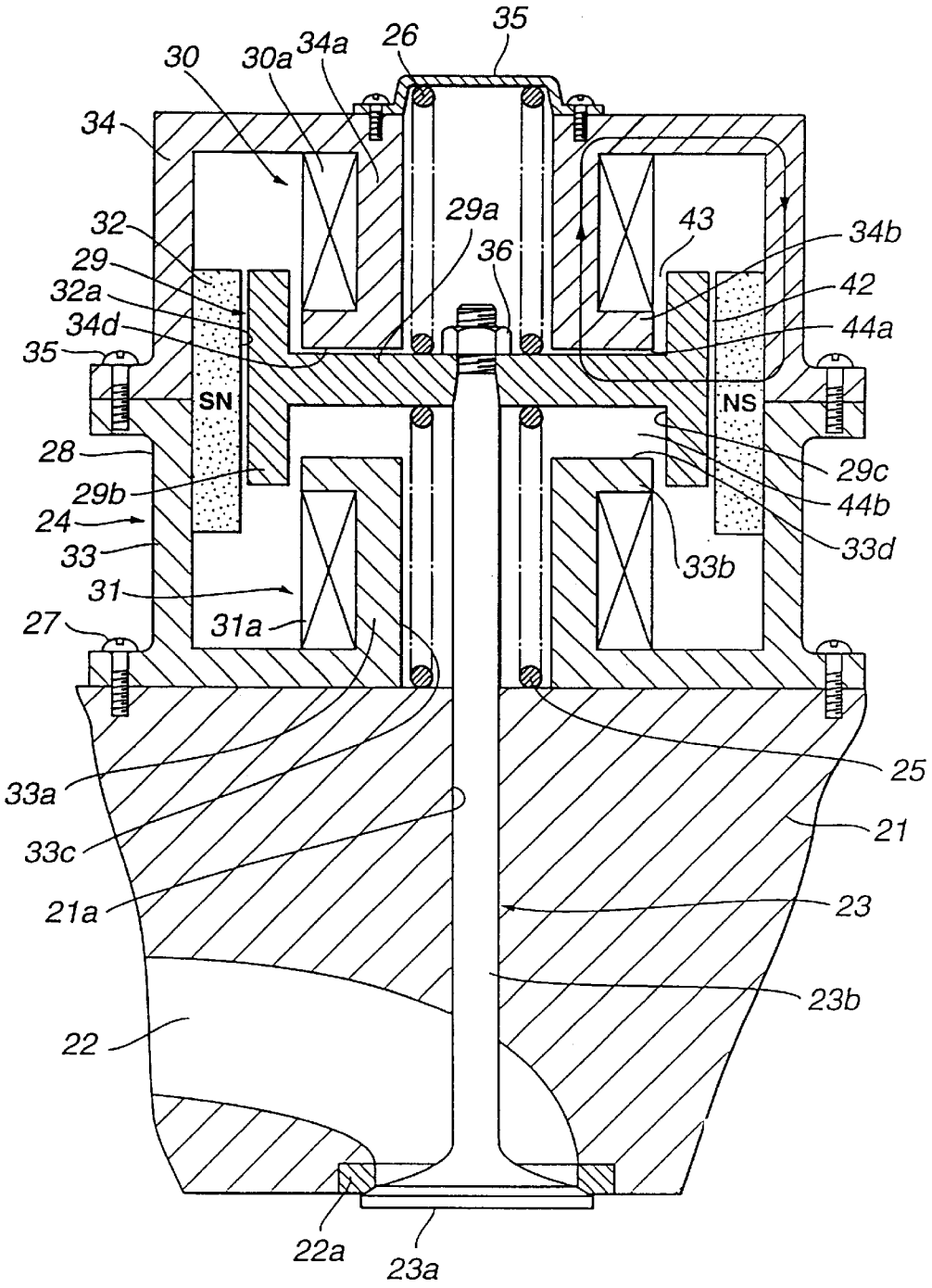
FIGS. 2A and 2B are views similar to FIG. 1 but respectively showing the electromagnetic valve actuator in different operating states in which an intake valve is placed in the closed position and the full open position.
Figure 2B:
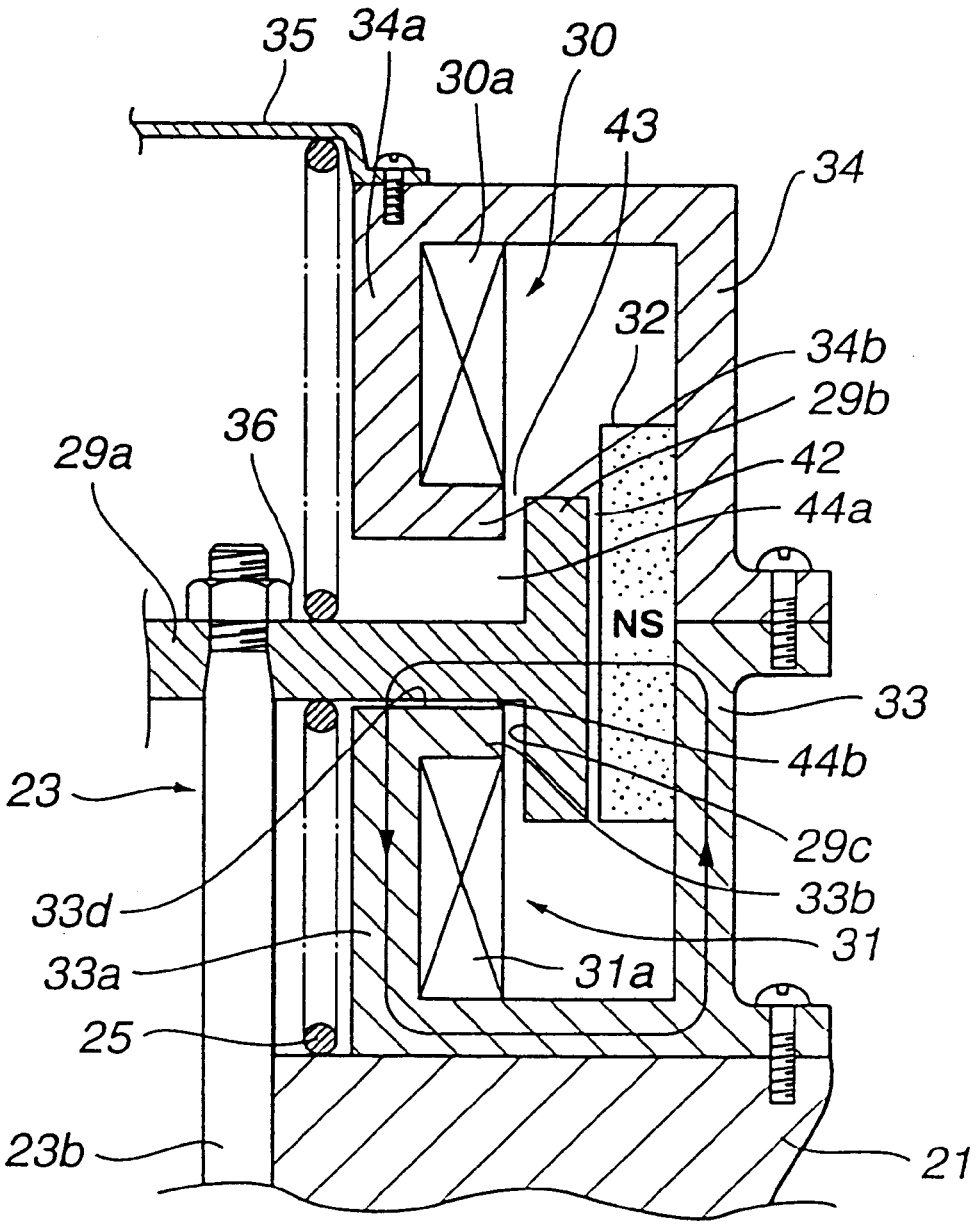

FIGS. 1, 2A and 2B illustrate the embodiment of an electromagnetic valve actuator according to the present invention, which is applied to an intake valve of an engine and may also be used with an exhaust valve of the engine.

Referring now to FIG. 1, the actuator includes an electromagnetically actuating mechanism 24 for actuating an intake valve 23 of a vehicle engine, a permanent magnet 32 retaining the intake valve 23 in a closed position thereof and a full open position thereof, and a valve-closing spring 25 and a valve-opening spring 26 that are adapted for biasing the intake valve 23 toward a neutral position between the closed and full open positions. FIG. 1 shows the intake valve 23 placed in the neutral position. The intake valve 23 is so configured as to open and close an open end of an intake port 22 formed in a cylinder head 21. The open end of the intake port 22 is exposed to a combustion chamber. The intake valve 23 includes a valve head 23*a* engageable with an annular valve seat 22*a* provided at the open end of the intake port 22. The intake valve 23 is engaged with the valve seat 22*a* in the closed position and disengaged therefrom in the full open position. The intake valve 23 also includes a valve stem 23*b* formed integrally with the valve head 23*a* and extending upwardly from the center of an upper surface of the valve head 23*a*. The valve stem 23*b* is slidably moved within a slide hole 21*a* formed in the cylinder head 21.

The electromagnetically actuating mechanism 24 includes a generally cylindrical housing 28 fixed to the cylinder head 21 through fastening bolts 27, an armature 29 disposed within the housing 28 so as to be moveable in a direction of a center axis X, and a pair of valve-closing and valve-opening electromagnets 30 and 31 attracting the armature 29 for moving the intake valve 23 to the closed and full open positions. The valve-closing electromagnet 30 and the valve-opening electromagnet 31 are disposed in an axially opposed and spaced relation to the armature 29.

The housing 28 includes a pair of generally cylindrical lower and upper housing halves 33 and 34 made of a magnetic material. The lower and upper housing halves 33 and 34 are connected together at opposed outer peripheral flanges thereof by using fastening bolts 35. The lower and upper housing halves 33 and 34 have substantially same structure. The lower housing half 33 includes a bottom wall and an inner sleeve 33*a* extending upwardly from a central portion of the bottom wall. The inner sleeve 33*a* has an upper radial flange 33*b* extending radially outwardly from an upper end portion of the inner sleeve 33*a*. The inner sleeve 33*a* with the upper radial flange 33*b* forms a reverse L-shape shown in FIG. 1 and cooperates with the bottom wall to define a cylindrical bore 33*c*. The upper housing half 34 includes a top wall and an inner sleeve 34*a* extending downwardly from a central portion of the top wall. The inner sleeve 34*a* has a lower radial flange 34*b* extending radially outwardly from a lower and portion of the inner sleeve 34*a*. The inner sleeve 34*a* with the lower radial flange 34*b* forms an L-shape shown in FIG. 1 and cooperates with the top wall to define a cylindrical bore 34*c* substantially axially aligned with the bore 33*c*. Through the bores 33*c* and 34*c*, an upper portion of the valve stem 23*b* is received moveably in the axial direction. A cover 35 is disposed on the top wall to close the bore 34*c*.

The permanent magnet 32 is secured to an inner circumferential surface of a middle portion of the housing 28 in which the lower and upper housing halves 33 and 34 are connected together. The permanent magnet 32 is arranged in a radially outwardly spaced relation to the inner sleeves 33*a* and 34*a* of the lower and upper housing halves 33 and 34. There is a suitable radial space between the permanent magnet 32 and the inner sleeves 33*a* and 34*a*, in which a portion of the armature 29 is disposed as explained later. The permanent magnet 32 has a cylindrical shape and a north magnetic pole N at an inner circumferential portion thereof and a south magnetic pole S at an outer circumferential portion thereof. The cylindrical permanent magnet 32 is increased in an axial length, i.e., in an inner circumferential area opposed to the armature 29, so as to sufficiently attract the armature 29. In this embodiment, the axial length of the permanent magnet 32 is greater than an entire axial length of the armature 29.

The armature 29 is disposed coaxially with the intake valve 23 and moveable together therewith upwardly and downwardly along the center axis X. The armature 29 has an H-shaped cross section shown in FIG. 1. The armature 29 includes a disk portion 29*a* and a sleeve portion 29*b* connected with an outer incumferential periphery of the disk portion 29*a* and integrally formed with the disk portion 29*a*. The disk portion 29*a* is fixed to a threaded upper end of the valve stem 23*b* by a nut 36 for the unitary motion with the intake valve 23. The disk portion 29*a* extends in a direction perpendicular to the center axis X and is disposed within an axial space S defined between the radial flange 34*b* of the inner sleeve 34*a* of the upper housing half 34 and the radial flange 33*b* of the inner sleeve 33*a* of the lower housing half 33. The disk portion 29*a* has an upper end face opposed to a lower axial end face 34*d* of the radial flange 34*b* with an axial air gap 44*a* and a lower end face opposed to an upper axial end face 33*d* of the radial flange 33*b* with an axial air gap 44*b*. The axial air gaps 44*a* and 44*b* are variable as the armature 29 moves along the center axis X, as explained in detail later. The sleeve portion 29*b* extends from the junction with the disk portion 29*a* in two opposing axial directions. The sleeve portion 29*b* is disposed in the radial space between the permanent magnet 32 and the radial flanges 33*b* and 34*b* of the inner sleeves 33*a* and 34*a*. The sleeve portion 29b has an outer circumferential surface opposed to an inner circumferential surface 32*a* of the permanent magnet 32 with a slight radial air gap 42. The outer circumferential surface of the sleeve portion 29*b* is entirely effective to be attracted by the permanent magnet 32 in the valve-neutral position, shown in FIG. 1, of the armature 29. The sleeve portion 29*b* has an inner circumferential surface 29*c* opposed to outer circumferential surfaces of the radial flanges 33*b* and 34*b* with radial air gaps 43. The radial air gaps 43 are disposed on the upper and lower sides of the disk portion 29*a*, respectively. Preferably, the radial air gaps 43 may be set at such a large value as to effectively reduce leakage of the magnetic flux of the electromagnets 30 and 31.

The valve-closing electromagnet 30 includes a magnetic core formed by the inner sleeve 34*a* of the upper housing half 34 and a coil 30*a* wound around an outer circumferential surface of the magnetic core. The magnetic core includes opposed pole piece portions formed by the lower and upper end portions of the inner sleeve 34*a*, respectively. The valve-opening electromagnet 31 includes a magnetic core formed by the inner sleeve 33*a* of the lower housing half 33 and a coil 31*a* wound around an outer circumferential surface of the magnetic core. The magnetic core includes opposed pole piece portions formed by the upper and lower end portions of the inner sleeve 33*a*, respectively. The coils 30*a* and 31*a* are connected in series and turned around the corresponding magnetic cores 34*a* and 33*a* in a same direction. One terminal end 37*a* of the coil 30*a* is connected with a terminal end 37*b* of the coil 31*a*. The other terminal ends 38*a* and 38*b* of the respective coils 30*a* and 31*a* are connected to a power source 40 and a controller 41 via an amplifier 39.

The controller 41 is programmed to determine an operating condition of the engine depending on signal outputs from detectors and develops a control signal for activating the coils 30*a* and 31*a* with an electric current. The detectors include a crank angle sensor 50 detecting the number of engine revolution and a temperature sensor 52 detecting temperatures of the electromagnets 30 and 31, and also may include an airflow meter. The controller 41 may be constituted by a microcomputer including microprocessor unit (MPU), input ports, output ports, read-only memory (ROM) for storing the control program, random access memory (RAM) for temporary data storage, and a conventional data bus.

The valve-closing spring 25 is installed in a compressed state within the bore 33*c* of the inner sleeve 33*a* of the lower housing half 33 and biases the armature 29 upwardly. Specifically, the valve-closing spring 25 has a lower end portion supported on an upper face of the cylinder head 21 and an upper end portion supported on a central portion of the lower end face of the disk portion 29*a* of the armature 29. The valve-opening spring 26 is installed in a compressed state within the bore 34*c* of the inner sleeve 34*a* of the upper housing half 34 and biases the armature 29 downwardly. Specifically, the valve-opening spring 26 has a lower end portion supported on a central portion of the upper end face of the disk portion 29*a* and an upper end portion supported on a rearside face of the cover 35. Setting loads of the valve-closing and valve-opening springs 25 and 26 are the same. The valve-closing and valve-opening springs 25 and 26 associate with each other to hold the armature 29 in a valve-neutral position, shown in FIG. 1, corresponding to the neutral position of the valve 23 when the coils 30*a* and 31*a* of the electromagnets 30 and 31 are not activated with an electric current.

An operation of the electromagnetic valve actuator will be explained hereinafter.

When the engine is stopped and the coils 30*a* and 31*a* of the valve-closing and valve-opening electromagnets 30 and 31 are not activated with an electric current, the armature 29 is placed in the valve-neutral position shown in FIG. 1. In this condition, the upper axial air gap 44*a* between the disk portion 29*a* of the armature 29 and the radial flange 34*b* of the inner sleeve 34*a* of the upper housing half 34 is equal to the lower axial air gap 44*b* between the disk portion 29*a* and the radial flange 33*b* of the inner sleeve 33*a* of the lower housing half 33. Densities of the magnetic fluxes of the permanent magnet 32 respectively extending toward the electromagnets 30 and 31 are equivalent.

Next, the engine starts and the coils 30*a* and 31*a* of the electromagnets 30 and 31 are activated with an electric current in such a direction that a south magnetic pole S is generated at the lower end portion of the inner sleeve 34*a* of the upper housing half 34 and a north magnetic pole N is generated at the upper end portion of the inner sleeve 33*a* of the lower housing half 33. Namely, the lower end portion with the radial flange 34*b*, of the inner sleeve 34*a* acts as the south magnetic pole piece portion S of the electromagnet 30 and the upper end portion with the radial flange 33*b*, of the inner sleeve 33*a* acts as the north magnetic pole piece portion N of the electromagnet 31. Thus, the lower pole piece portion of the electromagnet 30 and the upper pole piece portion of the electromagnet 31 have the opposing polarities S and N upon activating the serially-connected coils 30*a* and 31*a* wound in the same direction. In this condition, the density of the magnetic flux extending from the magnetic pole N of the permanent magnet 32 through the disk portion 29*a* of the armature 29 toward the S pole piece portion of the electromagnet 30 is larger, while the density of the magnetic flux extending from the magnetic pole N of the permanent magnet 32 through the disk portion 29*a* of the armature 29 toward the N pole piece portion of the electromagnet 31 is smaller. The armature 29 is attracted toward the S pole piece portion of the electromagnet 30 by the larger flux density. The armature 29 is then moved from the valve-neutral position to the valve-closing position against the spring force of the spring 26. As the armature 29 moves from the valve-neutral position toward the valve-closing position, the axial air gap 44*a* on the electromagnet 30 side becomes smaller while the axial air gap 44*b* on the electromagnet 31 side becomes greater. The intake valve 23 is upwardly moved with the armature 29 from the neutral position and placed in the closed position shown in FIG. 2A with the engagement of the valve head 23*a* with the valve seat 22*a*. The coils 30*a* and 31*a* are then instantly de-energized. Even in this condition where the coils 30*a* and 31*a* are de-energized, the intake valve 23 can be retained in the closed position by the attraction of the permanent magnet 32 relative to the armature 29. In the closed position of the intake valve 23, there is generated a magnetic flux circuit as indicated by arrow in FIG. 2A. Although only the right half of the magnetic flux circuit is shown in FIG. 2A for simple illustration, the left half thereof is similar to the right half. In the magnetic flux circuit, the magnetic flux extending from the magnetic pole N of the permanent magnet 32 passes through the radial air gap 42, the disk portion 29*a* of the armature 29, the smaller axial air gap 44*a* on the electromagnet 30 side, the lower end portion of the magnetic core 34*a* of the electromagnet 30 and the top wall and outer circumferential wall of the upper housing half 34, and enters the magnetic pole S of the permanent magnet 32.

Subsequently, for moving the intake valve 23 from the closed position to the full open position, the coils 30*a* and 31*a* are activated with a reverse electric current flowing in a direction opposite to the above-described direction. By the activation of the coils 30*a* and 31*a* with the reverse electric current, the magnetic pole N is generated at the lower end portion of the inner sleeve 34*a* of the upper housing half 34 and the magnetic pole S is generated at the upper end portion of the inner sleeve 33*a* of the lower housing half 33. Namely, conversely to the above-explained case of energization for moving the intake valve 23 to the closed position, the lower pole piece portion of the electromagnet 30 has the magnetic pole N and the upper pole piece portion of the electromagnet 31 has the magnetic pole S. The density of the magnetic flux extending from the magnetic pole N of the permanent magnet 32 toward the S pole piece portion of the electromagnet 31 becomes larger, while the density of the magnetic flux extending from the magnetic pole N of the permanent magnet 32 toward the N pole piece portion of the electromagnet 30 becomes smaller. In this state, there is generated a magnetic flux circuit in which the magnetic flux extending from the magnetic pole N of the permanent magnet 32 passes through the radial air gap 42, the disk portion 29*a* of the armature 29, the axial air gap 44*b* on the electromagnet 31 side, the S pole piece portion of the electromagnet 31, the bottom wall and the outer circumferential wall of the lower housing half 33 and enters the magnetic pole S of the permanent magnet 32. Substantially no or less amount of the magnetic flux passes through the permanent magnet 32 in a direction opposed to the magnetic flux of the permanent magnet 32. Thus, the permanent magnet 32 is prevented from being influenced by an undesired opposing magnetic field relative thereto which causes demagnetization thereof, upon energizing the coils 30*a* and 31*a* in the reverse direction. The armature 29 is attracted toward the S pole piece portion of the electromagnet 31. The armature 29 is moved toward the valve-neutral position with the assistance of the spring force of the spring 26 and then attractively moved to the valve-opening position, shown in FIG. 2B, against the spring force of the spring 25. Upon the motion of the armature 29 toward the valve-opening position, the axial air gap 44*b* on the electromagnet 31 side becomes smaller, while the axial air gap 44*a* on the electromagnet 30 side becomes greater. The variable axial air gap 44*a* and 44*b* are set in such a manner as to be smaller than the radial air gap 43 when the armature 29 is placed in the respective valve-closing and valve-opening positions as shown in FIGS. 2A and 2B. The intake valve 23 is downwardly moved with the armature 29 through the neutral position to the full open position in the disengagement of the vale head 23*a* from the valve seat 22*a*. The coils 30*a* and 31*a* are instantly de-energized. Even in this state, the intake valve 23 can be held in the full open position by the attraction of the permanent magnet 32 relative to the armature 29. In the full open position of the intake valve 23, there is generated a magnetic flux circuit indicated by arrow in FIG. 2B, in which the magnetic flux extending from the magnetic pole N of the permanent magnet 32 passes through the radial air gap 42, the disk portion 29*a* of the armature 29, the smaller axial air gap 44*b* on the electromagnet 31 side, the upper end portion of the magnetic core 33*a* of the electromagnet 31, the bottom wall and the outer circumferential wall of the lower housing half 33, and enters the magnetic pole S of the permanent magnet 32.

Figure 3:
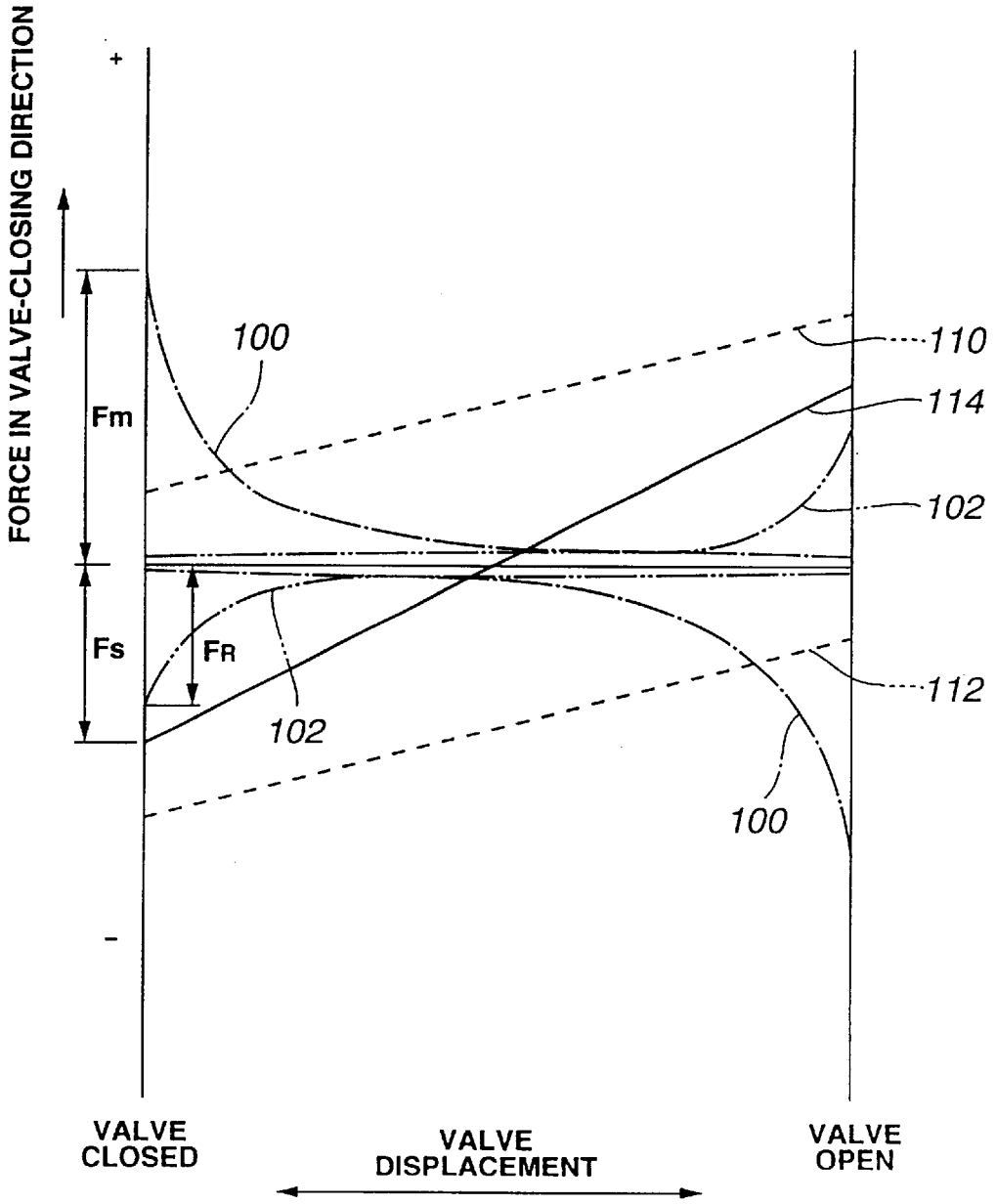
FIG. 3 is a diagram showing characteristic curves of a permanent magnet, electromagnets and springs.

FIG. 3 illustrates characteristic curves of the permanent magnet 32, the electromagnets 30 and 31 and the springs 25 and 26, which are exhibited upon shifting the intake valve 23 between the closed and full open positions. In FIG. 3, the permanent magnet 32 creates the attraction Fm as indicated by curves 100, exerted on the armature 29 against the spring forces 112 and 110 of the springs 26 and 25. When the intake valve 23 is in the respective closed and full open positions, the attraction Fm of the permanent magnet 32 overcomes the combined spring force Fs, as indicated by line 114, of the springs 25 and 26. When the coils 30*a* and 31*a* of the electromagnets 30 and 31 are activated with the reverse electric current for shifting the intake valve 32 between the closed and full open positions, the repulsion FR, as indicated by curve 102, of the armature 29 is generated. Namely, in the case of activation of the coils 30*a* and 31*a* with the reverse current for shifting the intake valve 32 from one of the closed and full open positions to the other thereof, the combined force of the combined spring force Fs and the repulsion FR of the armature 29 overcomes the attraction Fm of the permanent magnet 32 to eliminate the retention of the armature 29 by the permanent magnet 32. The intake valve 23 is thus urged to move from one of the closed and full open positions toward the other thereof.

Figure 4:
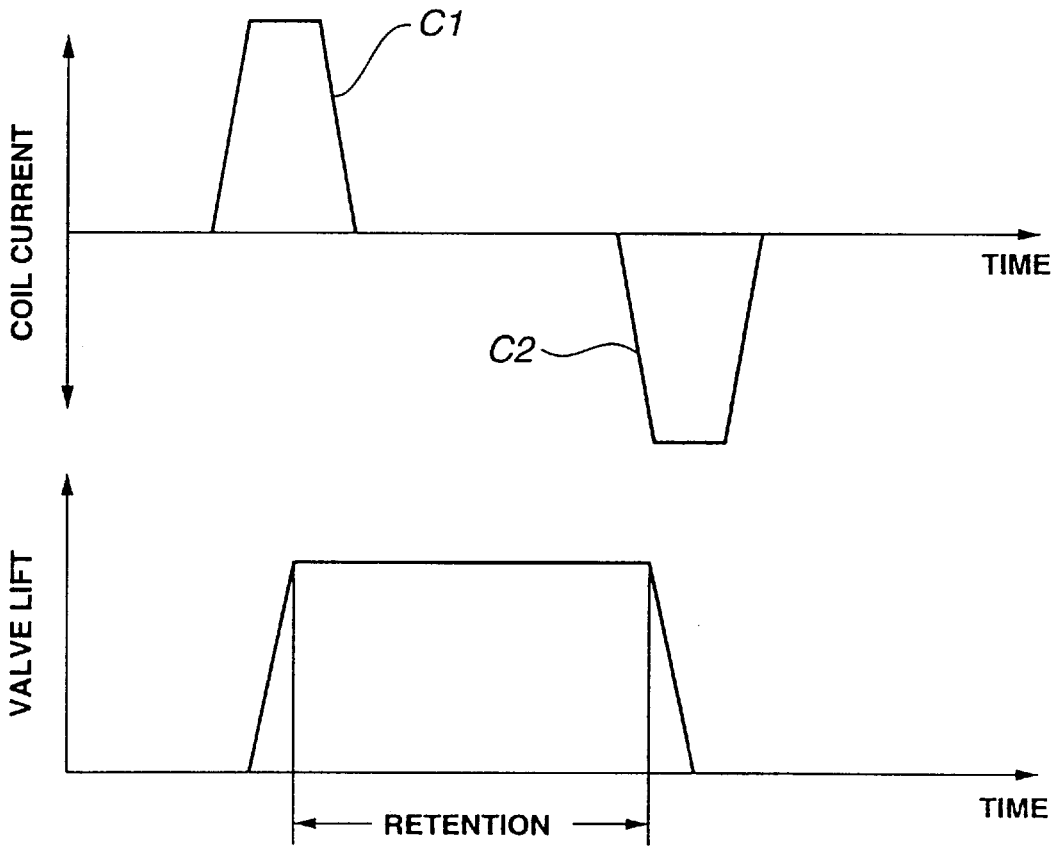
FIG. 4 illustrates timing diagrams of valve lift of the intake valve and coil current of the electromagnets.

Referring now to FIG. 4, a relationship between the activation of the coils 30*a* and 31*a* of the electromagnets 30 and 31 and the closing and opening motion of the intake valve 23 is explained. When activating the coils 30*a* and 31*a* with a coil current C1 shown in FIG. 4, for shifting the intake valve 23 from the closed position to the full open position, the intake valve 23 is moved from the closed position to the full open position owing to the spring force of the spring 26 and the attractive force of the electromagnet 31. Immediately after that, the energization of the coils 30*a* and 31*a* is stopped but the intake valve 23 is retained in the full open position as indicated by valve lift curve in FIG. 4, by the attraction of the permanent magnet 32. Likewise, when activating the coils 30*a* and 31*a* with a coil current C2 shown in FIG. 4, the intake valve 23 is moved from the full open position to the closed position in a manner reverse to that described above.

With the arrangement of the permanent magnet 32, it is not necessary to continuously supply an electric current to the coils 30*a* and 31*a* of the electromagnets 30 and 31 in order to attractively hold the armature 29 in the valve-closing and valve-opening positions. This also serves for reducing the electric power consumption.

Further, when the direction of the energization of the electromagnets 30 and 31 is reversed for moving the intake valve 23 from one of the closed position and the full open position to the other thereof, the armature 29 is attracted by the magnetic field of one of the electromagnets 30 and 31 which is the same as the magnetic field of the permanent magnet 32. Namely, the magnetic flux of the one of the electromagnets 30 and 31 is substantially prevented from passing through the permanent magnet 32 in the direction opposed to the direction of the magnetic flux of the permanent magnet 32. Thus, the permanent magnet 32 can be prevented from being influenced by the undesired opposing magnetic field relative to the magnetic field thereof and thus be effectively avoided from being demagnetized. This results in improving the durability of the permanent magnet 32.

Furthermore, since, upon the energization of the electromagnets 30 and 31 in the reverse direction, the magnetic flux is substantially prevented from passing through the permanent magnet 32 in the direction opposed to the magnetic flux of the permanent magnet 32, the reluctance in the magnetic flux circuit formed thereupon can be reduced. This causes reduction of the electric current supplied to the coils 30*a* and 31*a* required upon the energization thereof in the reverse direction. This can contemplate to reduction in power consumption.

Further, since the coils 30*a* and 31*a* of the electromagnets 30 and 31 are connected in series and wound in the same direction, the attractive force of one of the electromagnets 30 and 31 is exerted on the armature 29 with the assistance of the spring force of one of the springs 25 and 26 which is associated with the one of the electromagnets 30 and 31 upon the energization for shifting the intake valve 23 between the closed and open positions. This can improve the response motion of the armature 29.

Although the invention has been described above by reference to a certain embodiment of the invention, the invention is not limited to the embodiment described above. Modifications and variations of the embodiment described above will occur to those skilled in the art, in light of the above teachings. The scope of the invention is defined with reference to the following claims.

What is claimed is:

1. An apparatus for actuating a cylinder valve of an engine, the cylinder valve having a closed position, a full open position and a neutral position between the closed and full open positions, said apparatus comprising:

an armature moveable in a direction of an axis, said armature including a sleeve portion extending in the axial direction and a disk portion connected with a circumferential inner periphery of the sleeve portion and adapted to be fixed to the cylinder valve;

a pair of springs biasing the armature toward a valve-neutral position corresponding to the neutral position of the cylinder valve;

a pair of electromagnets attracting the armature for moving the cylinder valve to the closed and full open positions, said electromagnets being disposed in an axially opposed relation to the armature, said electromagnets including a pair of axially spaced magnetic cores; and a permanent magnet retaining the armature for holding the cylinder valve in the closed and full open positions;

wherein the sleeve portion of the armature cooperates with the permanent magnet to define a first air gap radially extending therebetween and cooperates with each of the magnetic cores to define a second air gap radially extending therebetween, and the disk portion of the armature cooperates with each of the magnetic cores to define a third air gap axially extending therebetween and variable with the axial motion of the armature.

2. An apparatus as claimed in claim 1, wherein each of the electromagnets includes a pair of coils connected in series and wound around the magnetic cores in a same direction.

3. An apparatus as claimed in claim 1, wherein the third air gap is smaller than the second air gap when the armature is placed in a valve-closing position corresponding to the closed position of the cylinder valve and a valve-opening position corresponding to the full open position of the cylinder valve.

4. An apparatus as claimed in claim 1, wherein the magnetic cores include sleeves extending coaxially with the sleeve portion of the armature and radial flanges radially outwardly extending from opposed axial end portions of the sleeves, respectively.

5. An apparatus as claimed in claim 4, wherein each of the radial flanges has a radial end face, said second air gap being disposed between the radial end face and the circumferential inner surface of the sleeve portion of the armature.

6. An apparatus as claimed in claim 1, wherein the permanent magnet has a cylindrical shape having such an increased axial length to be formed with an increased inner circumferential area opposed to the sleeve portion of the armature.

7. An apparatus as claimed in claim 6, wherein the increased axial length of the permanent magnet is greater than the sleeve portion of the armature.

8. An apparatus as claimed in claim 1, further comprising a housing made of a magnetic material, each of the magnetic cores being formed integrally with the housing.

* * * * *